US005322419A

United States Patent [19]

Novolan et al.

[11] Patent Number: 5,322,419

[45] Date of Patent: Jun. 21, 1994

[54] COMPRESSOR FOR DOMESTIC REFRIGERATORS

[75] Inventors: Traian Novolan, Tirgoviste; Ilie Ungureanu; Petru Nistor, both of Gaesti; Dumitru Bordea; Ion Paulescu, both of Bucharest; Matei Sandu; Stefan Saru, both of Gaesti, all of Romania

[73] Assignee: Arctic S.A., Gaesti, Romania

[21] Appl. No.: 50,906

[22] Filed: Apr. 20, 1993

Related U.S. Application Data

[63] Continuation-in-part of Ser. No. 678,264, filed as PCT/RO90/00002, on Sep. 21, 1990, Pat. No. 5,228,843.

[30] Foreign Application Priority Data

Oct. 6, 1989 [RO] Romania ..... 141894

[51] Int. Cl.[5] ..... F04B 35/04

[52] U.S. Cl. ..... 417/363; 417/372; 184/6.18

[58] Field of Search ..... 417/363, 368, 372, 902; 184/6.18, 6.16

[56] References Cited

U.S. PATENT DOCUMENTS

| | | | |
|---|---|---|---|
| 3,306,524 | 2/1967 | Matuki et al. | 417/363 |
| 3,441,202 | 4/1969 | Valbjorn et al. | 417/363 |
| 3,663,127 | 5/1972 | Cheers | 417/902 |
| 4,086,033 | 4/1978 | Stephan | 417/368 |
| 4,209,080 | 6/1980 | Douglas | 417/902 |
| 4,576,555 | 3/1986 | Ashenfelter | 417/372 |
| 4,582,468 | 4/1986 | Bar | 417/312 |
| 4,793,775 | 12/1988 | Peruzzi | 417/312 |
| 5,228,843 | 7/1993 | Novolan et al. | 417/363 |

*Primary Examiner*—Richard A. Bertsch
*Assistant Examiner*—Charles G. Freay
*Attorney, Agent, or Firm*—Herbert Dubno; Yuri Kateshov

[57] ABSTRACT

A freon operated compressor for domestic refrigerators has an electric motor that drives through a camshaft a piston sliding inside a cylinder block, while a system of valves provides for suction and delivery of the working fluid, a hollow body with a suction port in coaxial relation with a pipe, opposite which a triple pole terminal is arranged through which electrical power is supplied, and a pump provided with an outward cylindrical member and an ogival member with inner longitudinal blades and outward radial blades.

4 Claims, 6 Drawing Sheets

COMPRESSOR FOR DOMESTIC REFRIGERATORS

CROSS REFERENCE TO RELATED APPLICATIONS

This application is a continuation-in-part of Ser. No. 07/678,264 (U.S. Pat. No. 5,228,843) filed Apr 18, 1991 as a national phase of PCT/RO 90/00002 filed Sep. 21, 1990 and, based in turn, on a Romanian application 141894 of Oct. 6, 1989 under the International Convention.

FIELD OF THE INVENTION

This invention relates to a freon operated, hermetically sealed compressor for domestic refrigerators.

More particularly, the invention relates to a compressor comprising a hollow body so disposed that one of its suction ports is coaxially spaced from and close to a pipe through which the cooled working fluid is transferred to a cylinder block, a triple pole terminal for power supply diametrically opposed to the pipe, a plurality of compression springs attached to the casing bottom, as well as an oil pump resiliently secured to a shaft through the medium of an elastic ring mounted in a circular groove in the shape of a truncated cone.

Specifically the invention relates to a structure designed to improve refrigerating efficiency with less power absorbed from the supply network and affording an increased available space in the refrigerator.

BACKGROUND OF THE INVENTION

Freon operated, hermetically sealed compressors for use in domestic refrigerators are known and mainly comprise a casing containing an electric motor that drives by means of a camshaft a piston located inside a cylinder block. The working fluid is supplied through a suction pipe penetrating into a body that supports the entire assembly. Lubrication is achieved by a pump provided with a driving shaft, while the assembly within the casing is suspended from a plurality of springs, radially or perpendicularly disposed in relation to a horizontal plane, and attached to a plurality of ears secured to the casing and to the assembly. Electrical power is supplied through a triple pole terminal located close to the suction pipe through which the working fluid is circulated.

The main disadvantage of such compressors lies in an increased overall size of the casing since, for attaching the suspension springs of the compressor assembly, it is imperative that a plurality of inside ears be used. A further disadvantage is that the suction inlet is arranged opposite the suction pipe permitting some heating of the cooled working fluid that implicity results in a diminished volumetric efficiency of the compressor.

A further disadvantage is to be attributed to the oil pump and to its blade being press-fitted, so that the unit may have a comparatively lower pumping efficiency; in some cases it is possible for these parts to detach from one another, bringing about interruptions in operation.

Still a further disadvantage is the relatively high noise and vibration levels that can be attributed to the components supplying by suction the working fluid to the cylinder block to their suspension system, to the large clearances between adjacent component parts as well as to the comparatively high mass of the latter.

OBJECT OF THE INVENTION

It is therefore the object of the present invention to provide a domestic refrigerator with a high efficiency and better energy consumption.

SUMMARY OF THE INVENTION

The compressor, according to the invention has smaller dimensions compared with known subassemblies by redesigning a type of oil pump and a type of shaft to which the former is secured and by providing a hollow suction body for the cooled working fluid in order to achieve operating safety, increased refrigerating efficiency, high vibrational stability, a low noise level as well as an improved pumping efficiency for the lubricant supply system.

The compressor for domestic refrigerators in accordance with the present invention, comprises an electric motor driving, through the camshaft, a piston sliding inside a cylinder block. The compressor is provided with a hollow body disposed in such a manner that a suction port of the body and through which the working fluid penetrates into the cylinder block is coaxial with and close to the pipe through which the cooled working fluid is supplied. In other words, it is mounted diametrically opposite to the pipe. On the same axis there is a triple pole terminal for the energy supply and the bottom of the lower casing member houses a suspension system including four compression springs attached by means of upper and lower guides and adequately stiffened. The suspension means is located at the vertices of an isosceles trapezium so that center of gravity of the supported mass is on a vertical through the center of gravity of the trapezoidal support area and as close as possible to the latter. It also includes an oil pump resiliently attached to the driving shaft of the piston through the medium of an elastic ring disposed on the wall of a circular groove in the shape of a truncated cone. The ring exerts both radial and axial action on the pump.

More particularly, the compressor of the invention comprises:

a housing formed with upper and lower parts fitted together;

an electric motor resiliently mounted in the lower housing part and having an upwardly extending shaft formed with a passage displacing oil from the lower housing into the upper housing part;

an eccentric formed on an upper end of the shaft;

a horizontal piston-and-cylinder assembly comprising a cylinder mounted on the motor and a piston connected to the eccentric and reciprocatable thereby, the cylinder having an intake port opening at an end of the cylinder;

a cover coaxial with and mounted on the end of the assembly, the cover being formed with a groove extending parallel to the shaft axis;

a suction body received in the groove of the cover and extending downwardly therefrom along an axis and along side of the motor toward the lower housing part, the suction body being formed with a rear wall and a lid fitted together, the lid being provided with:

a pair of parallel longitudinal ribs projecting toward a wall of the lower housing part and spaced equidistantly from the axis, and a suction port formed on a lower part of the lid and turned toward a hole formed in a wall of the lower housing part, the hole being spaced from and aligned with the suction port, a drop-shaped formation centered on the axis below the ribs and surrounding the suction port, and a collar spaced axially apart from the suction port, the rear wall being formed with:

a neck formed with an outlet port spaced axially upwardly from the suction port, the collar being provided with mounting means for receiving the neck, a projection on the neck adapted to be mounted on the valve seat, the suction body being formed with a plurality of inner vertical, horizontal and bevelled walls forming respective chambers defining a refrigerant passage between the suction port and the outlet port being aligned with the intake port upon receiving of the neck and the collar in the groove, and drainage means spaced axially from the neck and the collar for evacuating drops of oil from the body; and a pipe connected to the wall and aligned with the hole for delivering a refrigerant to the housing whereby the refrigerant is drawn into the body through the suction port upon reciprocation of the piston in the cylinder.

The pump can have a plastic body formed with:

a pump having a plastic body made of revolution and having inner and outer peripheral surfaces, the body being formed with:

an upper cylindrical part provided with a pair of longitudinal ribs formed on the inner peripheral surface and extending radially inwardly toward and terminating at a distance from one another, a lower part tapering downwardly inwardly toward the shaft axis, the lower part being provided with a pair of blades spaced from the bottom and formed diametrically opposite on the outer surface and extending axially upwardly toward the upper part, a pair of arms formed diametrically oppositely one another on the upper part of the body and extending radially outwardly from the outer periphery, the shaft being provided with:

seats receiving the arms, the seats being formed with a flat surface tapering inwardly upwardly toward the arms of the body, a respective axial groove receiving the outer periphery of the cylindrical part of the body, and a flexible spring engaging the arms of the body and the flat surface of the seat of the shaft.

According to another aspect of the invention, the compressor can comprise:

a housing formed with an upper housing part and a lower housing part fitted together;

an electric motor resiliently mounted in the lower housing part and having an upwardly extending shaft formed with passages displacing oil from the lower housing part into the upper housing part;

an eccentric formed on an upper end of the shaft;

a horizontal piston-and-cylinder assembly comprising a cylinder mounted on the motor and a piston connected to the eccentric and reciprocatable thereby, the cylinder having an intake port opening at an end of the cylinder;

a suction body affixed to the end of the cylinder and extending downwardly along the motor, the suction body being formed with a downwardly extending passage and having a suction port at a lower portion of the body turned toward a whole formed in a wall of the lower housing part spaced from the suction port but aligned therewith; and a pipe connected to the wall and aligned with the hole for delivering a refrigerant to the housing whereby the refrigerant is drawn into the body through the suction port upon reciprocation of the piston in the cylinder.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
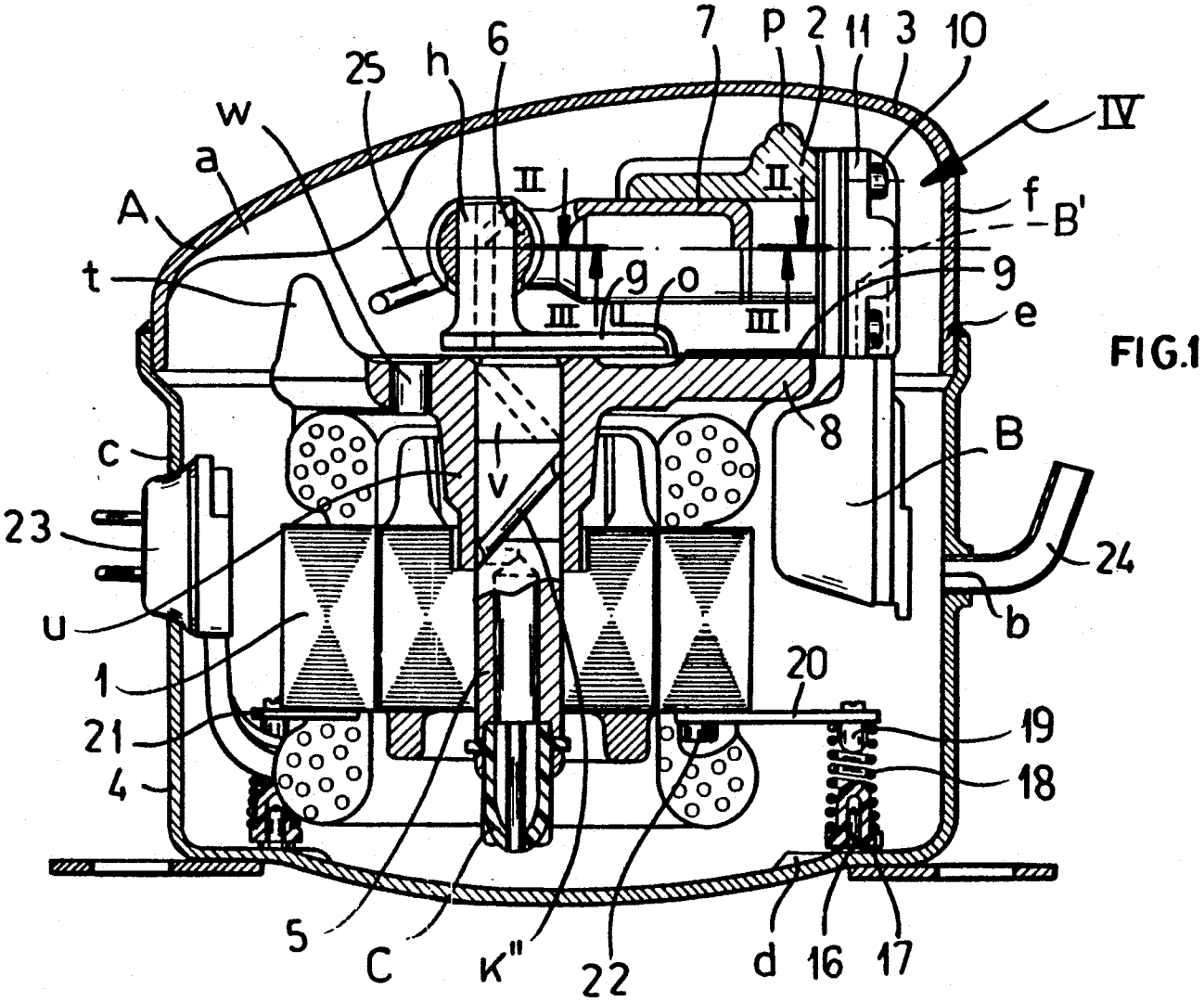
FIG. 1 is a vertical sectional view of the compressor for refrigerators according to the invention.

The compressor constructed according to the present invention comprises a casing A containing a hollow body B, a pump C, and an electric motor 1, and a cylinder block 2.

The casing A comprises an upper half-casing 3 and a lower half-casing 4 hermetically sealed together by any known technique, for example welding. The upper half-casing 3 has two inward protuberances a, one on each side of the longitudinal axis of the half-casing, while the lower half-casing 4 is provided with a small port b and a large port c, diametrically opposite one another and with their centers in the same plane, and with several planar surfaces d thus located as to coincide with the vertices of an isosceles trapezium.

The upper half-casing 3 has a lower oval portion e and an upper asymmetrical portion f for damping frequencies harmful to the hearing.

Through the medium of a shaft 5 and a slide 6, respectively, the rotational movement of the electric motor 1 is imparted to a piston 7 located within the cylinder block 2. The shaft 5 is provided with a counterbalance g close to which, but diametrically opposite is located an eccentric h to which is linked the slide 6.

Figure 2:
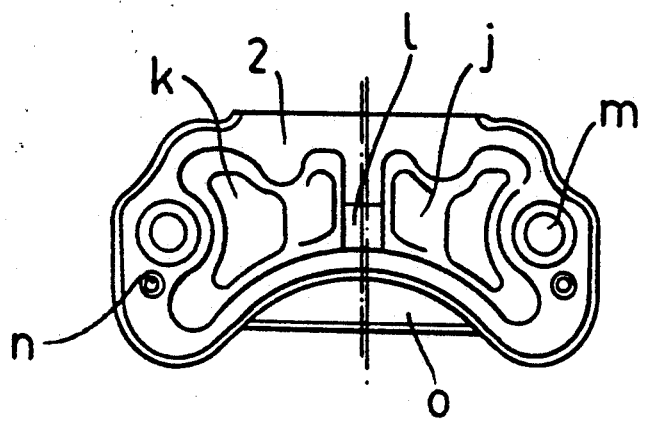
FIG. 2 is an end view of the cylinder subassembly.
Figure 3:
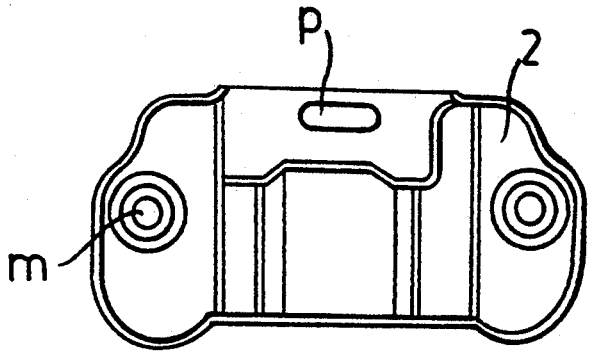
FIG. 3 is an end view of the cover of the cylinder subassembly.
Figure 4:
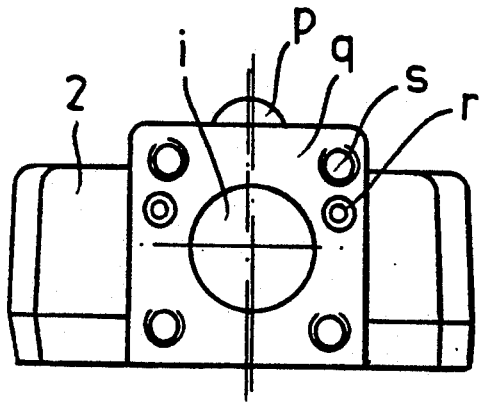
FIG. 4 is an opposite end view of the cylinder subassembly.

The cylinder block 2 is provided with an axial port i (FIG. 4) close to which are the recesses j and k, linked together through a short channel l (FIG. 2).

On each side of the recesses j and k the cylinder block 2 allows a plurality of fasteners to pass through holes m (FIG. 2). It also has positioning closed holes.

The counterbalance g partly penetrates into an outward recess o formed in the cylinder block 2.

In order to preserve the integrity of the assembly during transportation, the cylinder block 2 is provided with an upper protuberance p, close to the upper portion f of the upper half-casing 3. Two through holes r (FIG. 4) as well as four closed holes s, with their axes in parallel relation, are machined on the front face g of the cylinder block 2. The two through holes r serve as communication means for the working fluid, while the four closed holes s are provided for attaching several component parts.

The cylinder block 2 is attached to a body 8 by means of screws, not shown in the drawing, inserted into the fastening through holes m, positioned and adjusted by means of pins, equally not shown in the drawings, and engaging in the positioning closed holes n, while a planar resilient seal 9 is provided between the cylinder block 2 and the body 8. The body 8 has two upwardly oriented protuberances t, disposed opposite the inward protuberances a of the upper half-casing 3, as well as a plurality of recesses, not rendered in the drawings, and disposed opposite the recesses j and k in the cylinder block 2. On its lower side, the body 8 has a hub u (FIG. 1) into which partly penetrates the upper end v of the shaft 5, while the counterbalance g is placed above the body 8.

Close to the hub u the body 8 also has several holes w, of which at least two are machined opposite the cylinder block 2.

Figure 5:
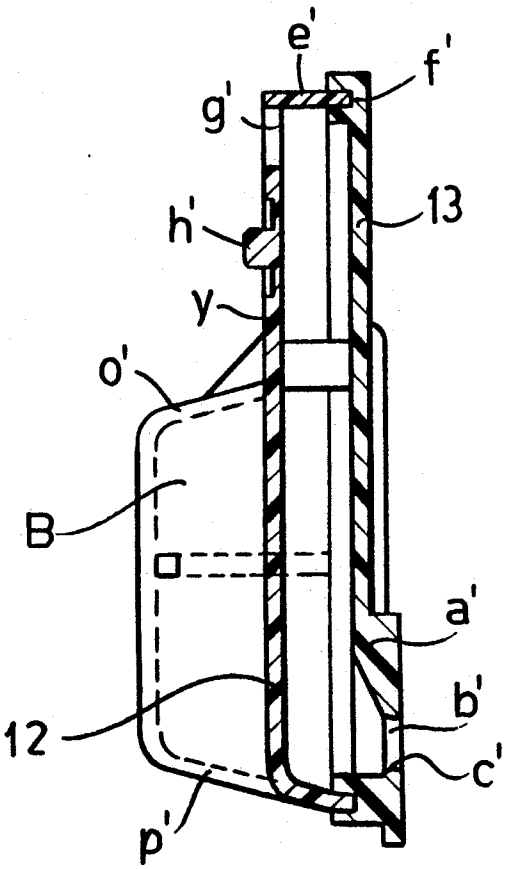
FIG. 5 is a longitudinal sectional view of the hollow body.
Figure 8:
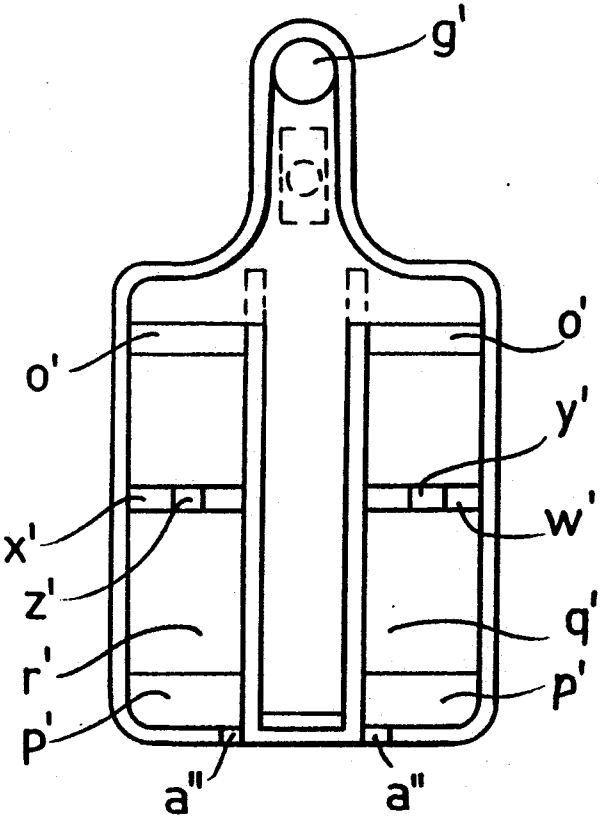
FIG. 8 is a frontal view of the alveolus of the hollow body.
Figure 7:
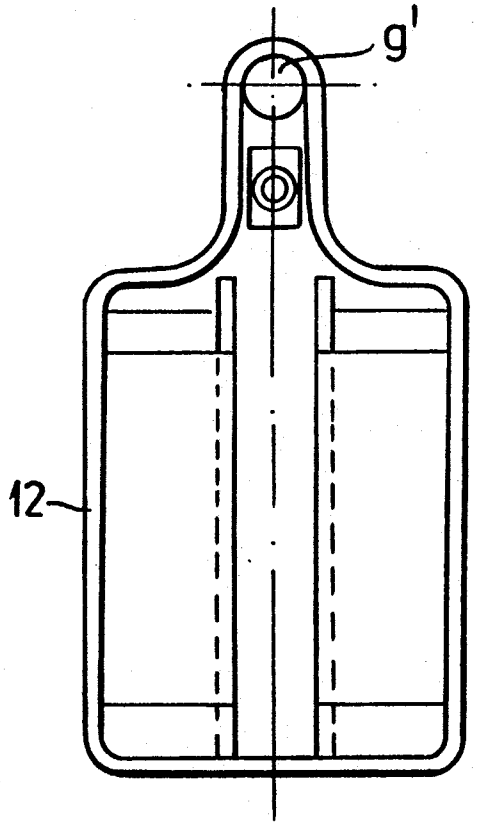
FIG. 7 is a rear view of the hollow body.

A suction device, a suction valve, a valve seat, a pressure valve and a packing not shown in the drawings, as well as a cylinder head cover 11 are securely attached to the front face q of the cylinder block 2 by means of screws 10 that penetrate into the closed holes s. The cylinder head cover has an axial recess B', into which axial recess penetrates a neck y (FIG. 5) of a component part 12 of the hollow body B.

Figure 6:
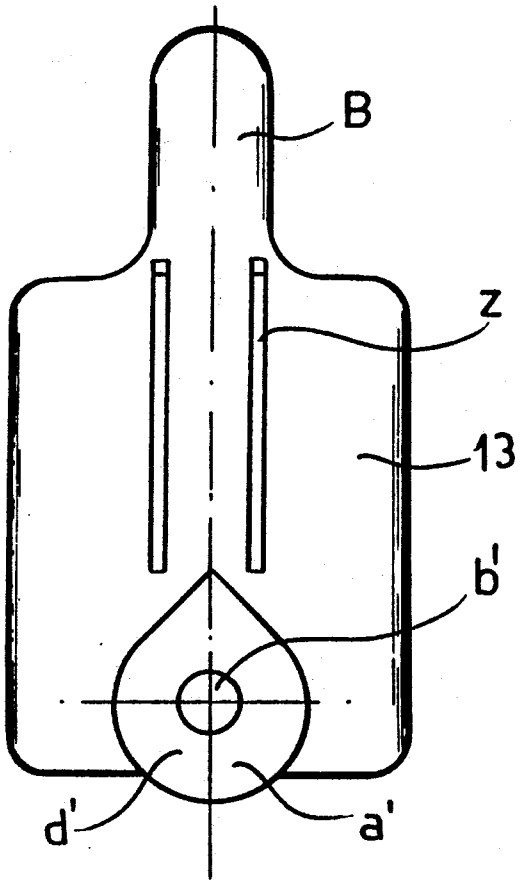
FIG. 6 is a frontal view of the hollow body.

The hollow body B also comprises a lid 13 sealingly attached, for instance by soldering to the component part 12. The lid 13 (FIG. 5) has two longitudinal ribs z (FIG. 6) symmetrically placed in relation to its axis of symmetry, and between which is provided a drop shaped formation a'. An axis of symmetry of the formation a' coincides with the one of the lid 13, while opposite the formation a' a suction port b' (FIG. 5) is machined in the lid 13. The port is defined by a converging wall c' whose center coincides with the center of the lower portion d' of said protuberance a'. For joining the collar e' of the component part 12 with the lid 13, the latter has a groove f' (FIG. 5) into which partly fits the collar e'.

Figure 9:
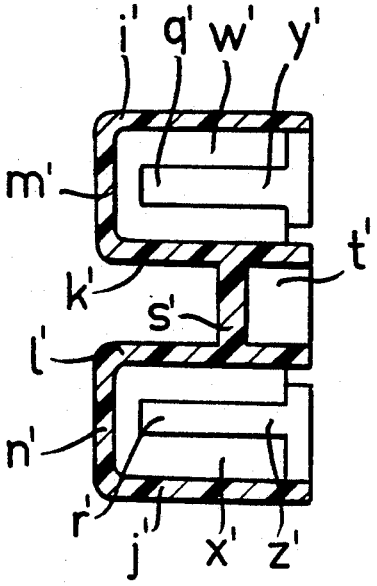
FIG. 9 is a transverse cross-sectional view through the alveolus.
Figure 10:
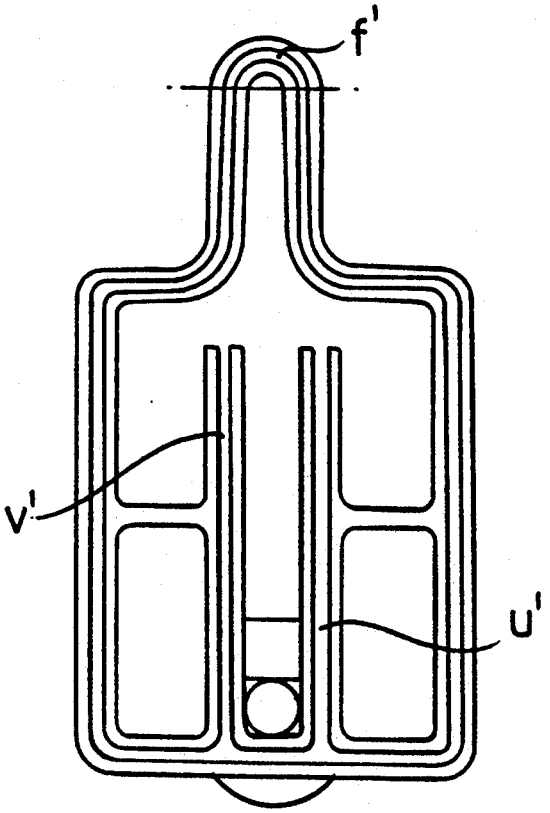
FIG. 10 is a rear view of a lid other hollow body.
Figure 13:
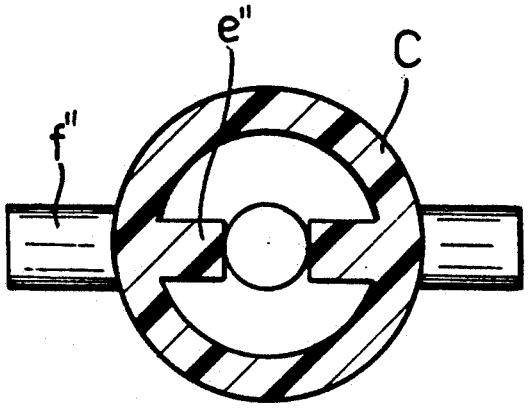
FIG. 13 is a cross-sectional view of a portion of the oil pump.

A hole g' is formed on the upper side of the component part 12, and below the hole is disposed a protuberance h' for positioning the hole g' in relation to the valve seat. Opposite the longitudinal ribs a, the component part 12 is provided with four vertical walls i', k', j' and l' (FIG. 9) which together with the vertical walls m' and n' and the inclined walls o and p, respectively, define the chambers g' and r'. The vertical walls k' and l' are linked together by a median wall s' which defines, together with the vertical walls k' and l', a median chamber t'. The lid 13 is provided also with the vertical grooves u' and v' into which the vertical walls k' and l' partly fit.

The median chamber t' is thus separated from the outside through the lid 13. The top of the median chamber t' communicates with the chambers q' and r' in order to minimize the noise level during the circulation of the working fluid. The chambers q' and r' are provided with central walls w' and x' provided in turn, with the recesses y' and z'.

On its lower side, the component part 12 shows two through holes a''. The suction port b' through which the cooled working fluid gains access by suction, is as close as possible to the small port b of the lower half-casing 4 and disposed on the same axis as the suction port.

It follows that the hollow body B performs the function of receiving the major part of the cooled working fluid and directing it, in the same cooled state, toward the axial port i' practiced in the cylinder block 2.

At the same time, under operating conditions, the hollow body B helps removing from the working fluid the oil sticking to its outward surface, as well as separating those oil drops that might have got inside it. Such separation is possible due to the formation of protuberance a' that deflects the oil film trickling down along the outward wall of lid 13, belonging to the hollow body B. The oil particles that have gotten inside the hollow body B, are being arrested through the inward, directed circulation of the working fluid. Ejection occurs through the through holes a''.

Figure 12:
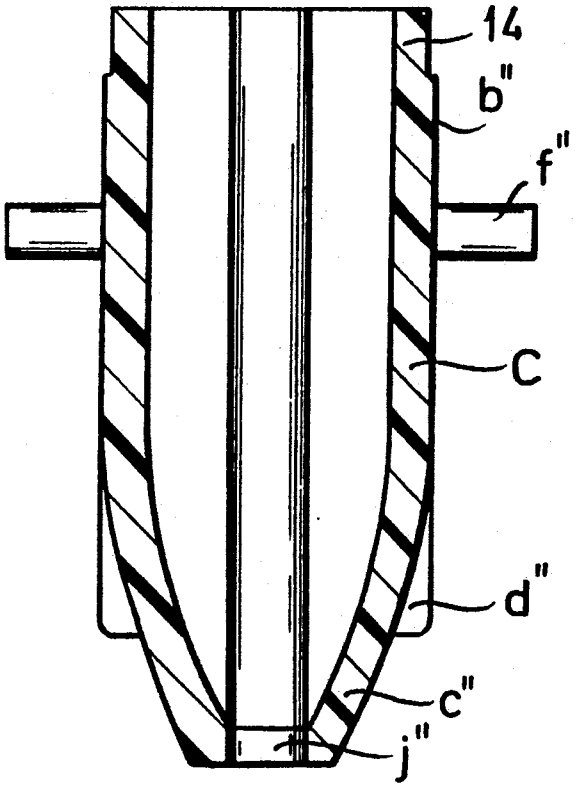
FIG. 12 is a longitudinal sectional view of the oil pump intake.
Figure 11:
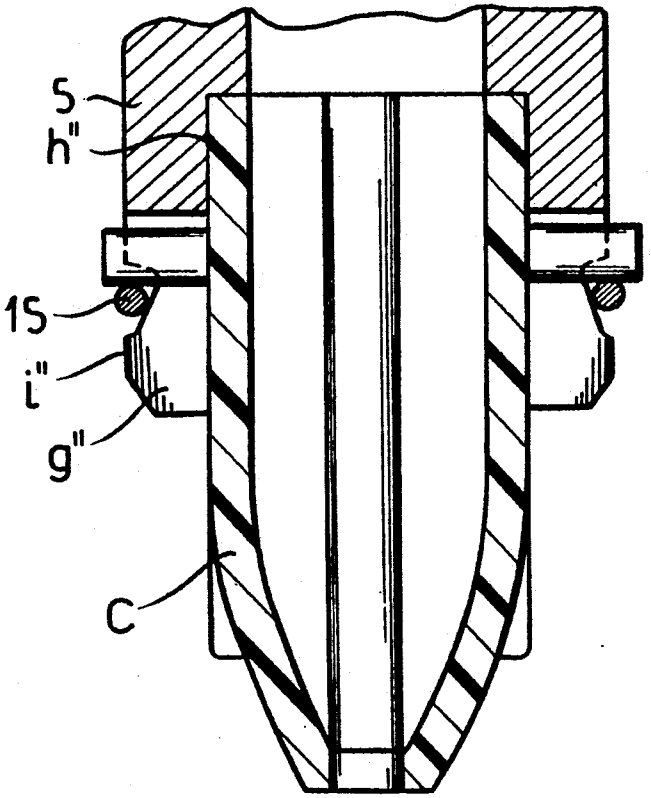
FIG. 11 is a detail of the intake of the oil pump used for the compressor for domestic refrigerators.

The pump C (FIGS. 11 and 12) consists of a body of revolution 14 with upper outward cylindrical portion b'', and a lower ogival portion c''. The ogival portion c'' is provided with radial blades d'' extending from the generators of the outward cylindrical portion b''.

Inwardly the body of revolution 14 is provided with diametrically opposed longitudinal blades e''.

Along the outward cylindrical portion b'', the body of revolution is provided with a plurality of diametrically opposed spurs f'' that fit into a plurality of grooves g'' practiced in the shaft 5, as soon as the outward cylindrical portion b'' partly fits into an axial hole h'' practiced in the shaft 5. The body 14 is maintained in its mounting position within the shaft 5 with an elastic ring 15 contacting the wall i'' of a circular groove in the shape of a truncated cone, in view of achieving a front contact between the body of revolution 14 and the shaft 5. The elastic ring 15 exerts a complex, both radial and axial, action on pump C.

The lower half-casing 4 contains an amount of oil in which is immersed the ogival portion c'' of the body of revolution 14.

To the plane surfaces d (FIG. 1) are attached a plurality of lower guides 16, on which are superposed a plurality of supports 17 whose outward shape is intended to maintain in their operating position a plurality of compression springs 18 equally attached to a plurality of upper guides 19 which, in turn, are rigidly joined together two by two by each of the plates 20 and 21.

The lower guides 16 and the upper guides 19 have their axes arranged in a line, and are placed in the vertices of an isosceles trapezium whose center of gravity is on the vertical of the center of gravity of the supported mass.

For maintaining in its position the supported mass, the plates 20 and 21 are thus dimensioned as to permit only limited displacements in a horizontal plane, until they contact the lower half-casing 4.

The body 8 is attached to the plates 20 and 21 by means of the screws 22 that go through the electric motor 1.

Electrical power is supplied to the electric motor 1 through a triple pole terminal 23 placed in the large port c of the lower half-casing 4, the triple pole terminal 23 being connected to the electric motor 1 in a point as close as possible to the former.

After starting the electric motor 1, a rotational movement is imparted to the pump C through the driving shaft 5 so that the oil is drawn through the lower port j'' of the body of revolution 14, and a helical groove k'' outside shaft 5, and pumped up to the upper half-casing 3.

In consequence of their impact with the upper half-casing 3 the oil drops descend and come to contact the assembly supported by the lower half-casing 4 as well as the entire inner surface of casing A, while oil equally circulates through the ports w formed in the body 8.

The working fluid is transported through a conduit 24, connected to the lower half-casing 4 where a small port b is formed in the latter, and enters the hollow body B through said small port b where it mainly goes through the median chamber t' as far as port g' through which it is expelled, and enters the cylinder block 2 where it is compressed and pushed into the cavity of the cylinder head cover 11 from which, after circulating through the holes r and the recesses j and k, it is discharged through a conduit 25 connected to the cylinder head cover 11. While at a standstill, the oil collected in the chambers q' and r' can flow out through the holes a'' and will avoid the suction port b' since due to the protuberance a' the oil is guided by the longitudinal ribs z.

The following benefits result from a compressor constructed according to the present invention:

more serviceable space in the refrigerating cabinet due to a smaller overall size of the casing;

an increased refrigerating efficiency by increasing the specific refrigerating power, and less electrical power tapped from the distribution network;

minimized noise and vibration levels;

shorter effective manufacturing time;

increased reliability;

lower materials and power demand.

We claim:

1. A compressor for a domestic refrigerator, said compressor comprising:

a housing formed with upper and lower parts fitted together;

an electric motor resiliently mounted in said lower housing part and having an upwardly extending shaft formed with a passage displacing oil from said lower housing into said upper housing part;

an eccentric formed on an upper end of said shaft;

a horizontal piston-and-cylinder assembly comprising a cylinder mounted on said motor and a piston connected to said eccentric and reciprocatable thereby, said cylinder having an intake port opening at an end of said cylinder;

a cover coaxial with and mounted on said end of said assembly, said cover being formed with a groove extending parallel to said shaft axis;

a suction body received in said groove of said cover and extending downwardly therefrom along an axis and along side of said motor toward said lower housing part, said suction body being formed with a rear wall and a lid fitted together, said lid being provided with:

a pair of parallel longitudinal ribs projecting toward a wall of said lower housing part and spaced equidistantly from said axis, a suction port formed on a lower part of said lid and turned toward a hole formed in a wall of said lower housing part, said hole being spaced from and aligned with said suction port, a drop-shaped formation centered on said axis below said ribs and surrounding said suction port, and a lid groove spaced from said suction port, said rear wall being formed with:

a neck formed with an outlet port at a top of the rear wall, a collar on said top and extending transversely to said axis toward said lid and received in said lid groove, a projection on said neck adapted to be mounted on said cover, said suction body being formed with a plurality of inner vertical, horizontal and bevelled walls forming respective chambers defining a refrigerant passage between said suction port and said outlet port, said outlet port being aligned with said intake port, and two throughholes spaced axially downwardly from said neck for evacuating drops of oil from said body; and a pipe connected to said wall and aligned with said hole for delivering a refrigerant to said housing whereby said refrigerant is drawn into said body through said section port upon reciprocation of said piston in said cylinder.

2. The compressor defined in claim 1 wherein said lid groove extends around a periphery of said lid and inwardly of said periphery to receive said inner walls formed on said rear wall said groove including respective upright grooves spaced from said periphery and receiving said inner vertical walls and a respective groove extending around the periphery and receiving said collar.

3. The compressor defined in claim 1, further comprising a pump having a plastic body made of revolution and having inner and outer peripheral surfaces, said plastic body being formed with:

an upper cylindrical part provided with a pair of longitudinal ribs formed on the inner peripheral surface and extending radially inwardly toward and terminating at a distance from one another, a lower part tapering downwardly inwardly toward said shaft axis, said lower part being provided with a pair of blades spaced from said bottom and formed diametrically opposite on the outer surface and extending axially upwardly toward said upper part, seats receiving said arms, said seats being formed with a flat surface tapering inwardly upwardly toward said arms of the body, a respective axial groove receiving said outer periphery of said cylindrical part of the plastic body, and a flexible spring engaging said arms of said plastic body and said flat surface of the seat of said shaft.

4. The compressor defined in claim 1, further comprising supply means for actuating said motor, said lower housing part being provided with means forming a large opening receiving said supply means and spaced diametrically opposite said hole, said lower housing part being formed with a bottom provided with a plurality of supports having flat horizontal surfaces supporting the spring means including a plurality of compression springs, said upper housing part being formed with a peripheral oval section formed with opposite longitudinal sides and with a pair of protuberances each formed along a respective one of said opposite longitudinal sides and extending inwardly toward said lower housing part.

* * * * *